US006960291B2

(12) United States Patent
Greaney et al.

(10) Patent No.: US 6,960,291 B2
(45) **Date of Patent: *Nov. 1, 2005**

(54) NAPHTHA DESULFURIZATION METHOD

(75) Inventors: Mark A. Greaney, Upper Black Eddy, PA (US); Binh N. Le, Humble, TX (US); Daniel P. Leta, Flemington, NJ (US); John N. Begasse, Livingston, NJ (US); Charles T. Huang, Houston, TX (US); Verlin Keith Turner, LaPorte, TX (US)

(73) Assignees: ExxonMobil Research and Engineering Company, Annandale, NJ (US); Merichem Company, Houston, TX (US)

( * ) Notice: Subject to any disclaimer, the term of this patent is extended or adjusted under 35 U.S.C. 154(b) by 415 days.

This patent is subject to a terminal disclaimer.

(21) Appl. No.: 10/161,953

(22) Filed: Jun. 4, 2002

(65) Prior Publication Data

US 2003/0052044 A1 Mar. 20, 2003

Related U.S. Application Data

(60) Provisional application No. 60/299,329, filed on Jun. 19, 2001, provisional application No. 60/299,330, filed on Jun. 19, 2001, provisional application No. 60/299,331, filed on Jun. 19, 2001, provisional application No. 60/299,346, filed on Jun. 19, 2001, and provisional application No. 60/299,347, filed on Jun. 19, 2001.

(51) Int. Cl.[7] ..... C10G 67/10; C10G 19/02

(52) U.S. Cl. ..... 208/203; 208/212; 208/226; 208/228; 208/229; 208/230; 208/235

(58) Field of Search ..... 208/203, 226, 208/228, 229, 230, 235, 212

(56) References Cited

U.S. PATENT DOCUMENTS

| | | | | | |
|---|---|---|---|---|---|
| 2,770,581 | A | | 11/1956 | Brooks, Jr. et al. | 196/41 |
| 2,850,434 | A | | 9/1958 | Brooks, Jr. et al. | 196/32 |
| 2,853,432 | A | | 9/1958 | Gleim et al. | 196/32 |
| 2,868,722 | A | | 1/1959 | Brooks, Jr. et al. | 208/263 |
| 2,882,224 | A | | 4/1959 | Gleim et al. | 208/206 |
| 2,921,021 | A | | 1/1960 | Urban et al. | 208/205 |
| 2,966,453 | A | | 12/1960 | Gleim et al. | 208/206 |
| 2,976,229 | A | | 3/1961 | Brown et al. | 208/2 |
| 3,186,934 | A | | 6/1965 | Neilsen | 208/2 |
| 3,409,543 | A | * | 11/1968 | Urban et al. | 208/234 |
| 3,445,380 | A | | 5/1969 | Urban | 208/206 |
| 3,574,093 | A | * | 4/1971 | Strong | 208/206 |
| 3,977,829 | A | | 8/1976 | Clonts | 23/267 |
| 3,992,156 | A | | 11/1976 | Clonts | 23/267 |
| 4,040,947 | A | | 8/1977 | Christman | 208/235 |
| 4,104,155 | A | | 8/1978 | Christman | 208/235 |
| 4,265,735 | A | | 5/1981 | Audeh et al. | 208/234 |
| 4,362,614 | A | | 12/1982 | Asdigian | 208/235 |
| 4,404,098 | A | | 9/1983 | Asdigian | 208/235 |
| 4,562,300 | A | * | 12/1985 | LaFoy | 585/854 |
| 4,666,689 | A | * | 5/1987 | Maple et al. | 423/183 |
| 4,705,620 | A | * | 11/1987 | Bricker et al. | 208/206 |
| 4,753,722 | A | | 6/1988 | Le et al. | 208/207 |
| 4,875,997 | A | * | 10/1989 | Langford | 208/235 |
| 5,318,690 | A | | 6/1994 | Fletcher et al. | 208/89 |
| 5,360,532 | A | | 11/1994 | Fletcher et al. | 208/89 |
| 5,569,788 | A | | 10/1996 | Forte et al. | 568/697 |
| 5,582,714 | A | | 12/1996 | Forte | 208/237 |
| 5,689,033 | A | | 11/1997 | Forte et al. | 585/833 |
| 5,961,819 | A | * | 10/1999 | Lee et al. | 208/230 |
| 5,997,731 | A | | 12/1999 | Suarez | 208/230 |
| 6,007,704 | A | | 12/1999 | Chapus et al. | 208/218 |
| 6,126,814 | A | | 10/2000 | Lapinski et al. | 208/217 |
| 6,228,254 | B1 | | 5/2001 | Jossens | 208/212 |
| 6,352,640 | B1 | | 3/2002 | Cook et al. | 208/237 |

OTHER PUBLICATIONS

C. A. Duval and V. A. Kalichevsky, Magnolia Petroleum Co., Beaumont, TX, "Dualayer Gasoline Treating Process," Petroleum REFINER, Apr. 1954, vol. 33, No. 4, pp. 161–163.

C. A. Duval and V. A. Kalichevsky, "Treating Gasoline by DUALAYER PROCESS," The Oil and Gas Journal, Apr. 12, 1954, pp. 122–123, 150–151.

V. A. Kalichevsky, Magnolia Petroleum Co., Beaumont, TX, "New Mercaptan–Removal Process," The Oil FORUM, Jun., 1954, pp. 194–195.

* cited by examiner

*Primary Examiner*—Walter D. Griffin
(74) *Attorney, Agent, or Firm*—Gerard J. Hughes

(57) ABSTRACT

The invention relates to a method for desulfurizing naphtha boiling-range hydrocarbons such as cracked naphtha. More particularly, the invention relates to hydrotreating the naphtha under selective hydrotreating conditions, and then removing mercaptans from the hydrotreater effluent using a caustic extractant.

24 Claims, 2 Drawing Sheets n=1 : 3-methyl phenol
n=2 : 2,4-dimethyl phenol
n=3 : 2,3,5 trimethyl phenol

NAPHTHA DESULFURIZATION METHOD

CROSS-REFERENCE TO RELATED APPLICATIONS

This application claims benefit of U.S. Provisional Patent Applications Ser. Nos. 60/299,329; 60/299,330; 60/299,331; 60/299,346; and 60/299,347, all filed on Jun. 19, 2001.

FIELD OF THE INVENTION

The invention relates to a method for desulfurizing naphtha boiling-range hydrocarbons such as cracked naphtha. More particularly, the invention relates to hydrotreating the naphtha under selective hydrotreating conditions, and then removing mercaptans from the hydrotreater effluent using a caustic extractant.

BACKGROUND OF THE INVENTION

Naphtha streams are primary petroleum refinery products. These streams are blended to makeup what is referred to in the industry as the "gasoline pool". One problem associated with such streams, especially those naphtha streams which are products of a cracking process, such as fluidized catalytic cracking and coking, is that they contain relatively high levels of undesirable sulfur. They also contain valuable olefins which contribute to the octane number of the resulting gasoline pool, and thus it is highly desirable not to saturate them to lower octane paraffins during processing. There is a continuing need therefore, for hydrodesulfurization catalysts and processes for desulfurizing naphtha feed streams, while attempting to keep olefin saturation at a minimum.

Hydrodesulfurization that preserve olefins while removing sulfur are frequently referred to as selective hydrotreating processes. Undesirably, in selective hydrotreating a portion of the preserved olefins reacts with $H_2S$ to form mercaptans. Such mercaptans are referred to as reversion mercaptans to distinguish them from the mercaptans found in the feed to the hydrodesulfurizer. Even though two-stage hydrodesulfurization processes curtail reversion mercaptan formation through, e.g. inter-stage $H_2S$ separation, some reversion mercaptans may remain. Increasingly stringent sulfur specifications for gasoline may require still lower levels of mercaptans, including reversion mercaptans, to meet product specifications.

Mercaptans may be removed from naphtha with conventional aqueous treatment methods. In one conventional method, the naphtha contacts an aqueous treatment solution containing an alkali metal hydroxide. The naphtha contacts the treatment solution, and mercaptans are extracted from the naphtha to the treatment solution where they form mercaptide species. The naphtha and the treatment solution are then separated, and a treated naphtha is conducted away from the process. Intimate contacting between the naphtha and aqueous phase leads to more efficient transfer of the mercaptans from the naphtha to the aqueous phase, particularly for mercaptans having a molecular weight higher than about $C_4$. Such intimate contacting often results in the formation of small discontinuous regions (also referred to as "dispersion") of treatment solution in the naphtha. While the small aqueous regions provide sufficient surface area for efficient mercaptan transfer, they adversely affect the subsequent naphtha separation step and may be undesirably entrained in the treated naphtha.

Efficient contacting may be provided with reduced aqueous phase entrainment by employing contacting methods that employ little or no agitation. One such contacting method employs a mass transfer apparatus comprising substantially continuous elongate fibers mounted in a shroud. The fibers are selected to meet two criteria. The fibers are preferentially wetted by the treatment solution, and consequently present a large surface area to the naphtha without substantial dispersion or the aqueous phase in the naphtha. Even so, the formation of discontinuous regions of aqueous treatment solution is not eliminated, particularly in continuous processes.

In another conventional method, the aqueous treatment solution is prepared by forming two aqueous phases. The first aqueous phase contains alkylphenols, such as cresols (in the form of the alkali metal salt), and alkali metal hydroxide, and the second aqueous phase contains alkali metal hydroxide. Upon contacting the hydrocarbon to be treated, mercaptans contained in hydrocarbon are removed from the hydrocarbon to the first phase, which has a lower mass density than the second aqueous phase. Undesirable aqueous phase entrainment is also present in this method, and is made worse when employing higher viscosity treatment solutions containing higher alkali metal hydroxide concentration.

There remains a need, therefore, for improved naphtha desulfurization processes capable of efficiently removing sulfur, particularly mercaptan sulfur, without undue aqueous contamination of the treated naphtha.

SUMMARY OF THE INVENTION

In an embodiment, the invention relates to a naphtha desulfurization method, comprising:

(a) contacting a sulfur-containing naphtha with hydrogen in the presence of a catalytically effective amount of a hydrotreating catalyst under catalytic hydrotreating conditions to form a hydrodesulfurized naphtha;

(b) contacting the hydrodesulfurized naphtha with a first phase of a treatment composition containing water, alkali metal hydroxide, cobalt phthalocyanine sulfonate, and alkylphenols and having at least two phases, (i) the first phase containing dissolved alkali metal alkylphenylate, dissolved alkali metal hydroxide, water, and dissolved sulfonated cobalt phthalocyanine, and (ii) the second phase containing water and dissolved alkali metal hydroxide;

(c) extracting mercaptan sulfur from the hydrodesulfurized naphtha to the first phase; and (d) separating an upgraded naphtha having less mercaptan sulfur than the hydrodesulfurized naphtha.

In a preferred embodiment, the process is a continuous process further comprising conducting an oxidizing amount oxygen and the first phase containing mercaptan sulfur to an oxidizing region and oxidizing the mercaptan sulfur to disulfides, separating the disulfides from the first phase; and then conducting the first phase to step (b) for re-use. Preferably, the contacting of step (b) is conducted in the absence of added oxygen, i.e., under substantially anaerobic conditions.

In another an embodiment, the invention relates to a naphtha desulfurization method, comprising:

(a) contacting a sulfur-containing naphtha with hydrogen in the presence of a catalytically effective amount of a hydrotreating catalyst under catalytic hydrotreating conditions to form a hydrodesulfurized naphtha;

(b) contacting the hydrodesulfurized naphtha with an extractant composition, wherein (i) the extractant is substantially immiscible with its analogous aqueous alkali metal hydroxide, and (ii) the extractant contains water, dissolved alkali metal alkylphenylate, dissolved alkali metal hydroxide, and dissolved sulfonated cobalt phthalocyanine;

(c) extracting mercaptan sulfur from the hydrodesulfurized naphtha to the extractant; and (d) separating an upgraded naphtha having less mercaptan sulfur than the hydrodesulfurized naphtha.

In a preferred embodiment, the process is a continuous process further comprising conducting an oxidizing amount of oxygen or some other oxygen-containing gas and the extractant containing mercaptan sulfur to an oxidizing region and oxidizing the mercaptan sulfur to disulfides, separating the disulfides from the extractant; and then conducting the extractant to step (b) for re-use. Preferably, the contacting of step (b) is conducted in the absence of added oxygen, i.e., under substantially anaerobic conditions.

DETAILED DESCRIPTION OF THE INVENTION

Figure 1:
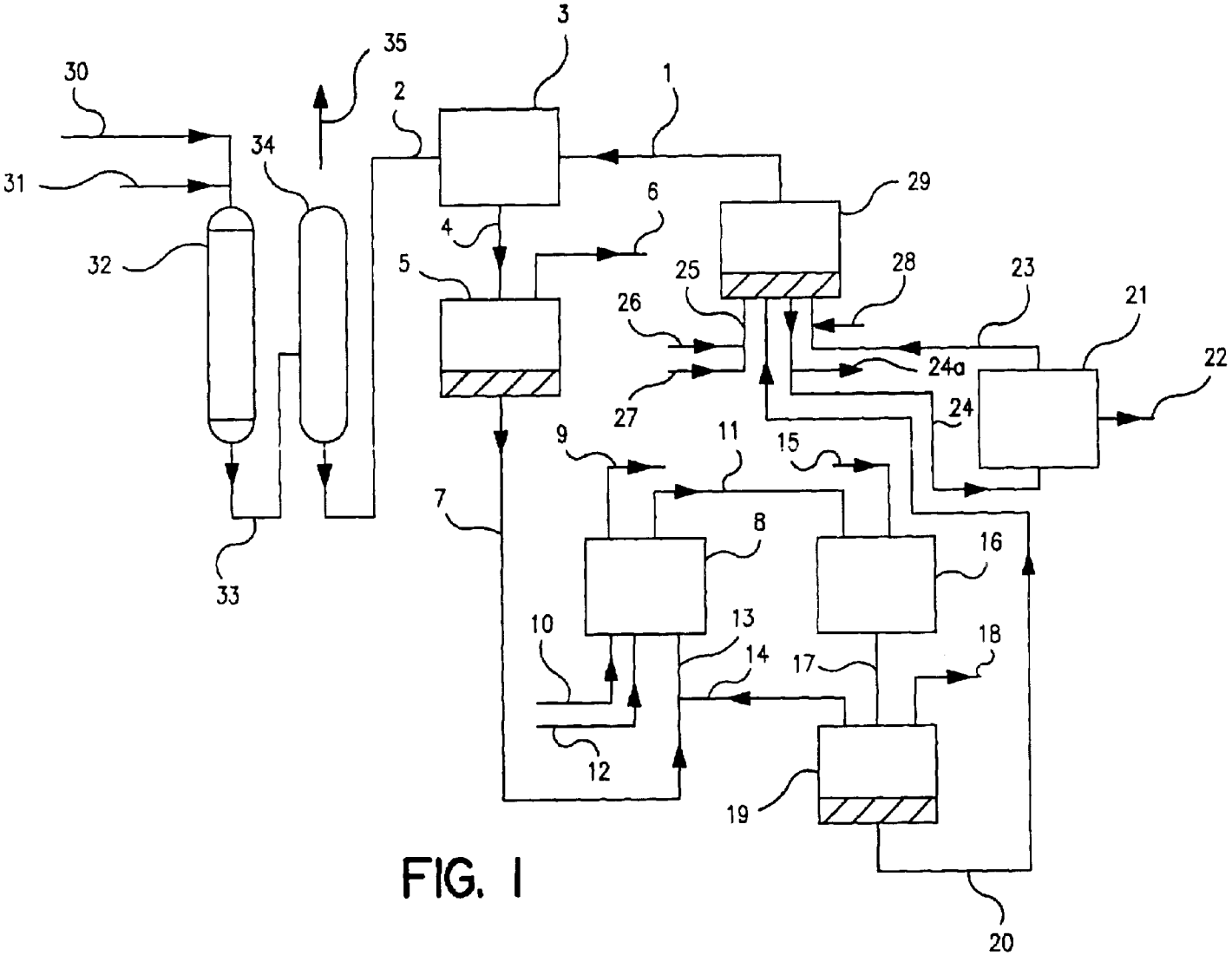
FIG. 1 shows a schematic flow diagram for one embodiment.

Naphtha boiling range hydrocarbons may contain sulfur compounds such as mercaptans, aromatic heterocyclic compounds, and disulfides, and at least a portion of such sulfur compounds are removed or converted prior to blending the naphtha with other components to form a gasoline suitable for use as a fuel. Relative amounts of the sulfur compounds depend on a number of factors, but aromatic heterocyclic sulfur compounds tend to be present in undesirable amounts, particularly in the heavier naphtha fractions. While severe hydrotreating conditions have been conventionally specified for naphtha hydrodesulfurization, such conditions may result in a large octane number penalty. Conventional, non-hydrotreating processes, used as an alternative to hydrogen processing, have relatively low sulfur removal efficiencies, since the aromatic heterocyclic sulfur compounds have adsorptive properties similar to the aromatic compounds in the hydrocarbon matrix.

In order to prevent undue octane number loss, a hydrotreating step operated at very mild conditions of temperature, pressure and feed rate may be employed to curtail olefin saturation. Such hydrotreating is referred to as selective hydrotreating. However, when selective hydrotreating is employed, even though 90% or more of the aromatic heterocyclic sulfur compounds are removed, the amount of mercaptans present in the hydrotreated naphtha product may remain the same or even increase. While not wishing to be bound, it is believed that the some of the olefins preserved react with $H_2S$ in the hydrotreater to form reversion (also called recombinant) mercaptans. Unfortunately, these reversion or recombinant mercaptans may be branched, have molecular weights higher than about $C_4$ or $C_5$, or both, which make them difficult to remove from the hydrotreated naphtha product by conventional methods.

The invention relates in part to the discovery that aqueous treatment solutions useful for removing mercaptan sulfur from hydrotreated naphtha, particularly selectively hydrotreated naphtha, may be formed from water, dissolved alkali metal hydroxide, dissolved sulfonated cobalt phthalocyanine, and dissolved alkali metal alkylphenylate. While not wishing to be bound by any theory or model, it is believed that the presence of sulfonated cobalt phthalocyanine in the treatment solution lowers the interfacial energy between the aqueous treatment solution and the naphtha, which enhances the rapid coalescence of the discontinuous aqueous regions in the naphtha thereby enabling more effective separation of the treated naphtha from the treatment solution. This in turn allows the use of high hydroxide concentration treatment solutions, which have higher extractant power for $C_4$, $C_5$, and higher molecular weight mercaptans (such as reversion mercaptans) than conventional treatment solutions.

Thus, the reduction in mercaptan reversion achieved by two stage processes, i.e., selective hydrotreating followed by mercaptan extraction, produces a naphtha product useful in forming gasoline both low total sulfur and mercaptan sulfur, while preserving the olefins valuable for octane number. At technologically important deep desulfurization levels, e.g., 90–100 wt. % feed sulfur removal, particularly with relatively high sulfur content naphtha feeds (e.g., >1000–7000 wppm sulfur), the contribution of sulfur from reversion mercaptans to the total sulfur, can be significant. Therefore, the control of mercaptan formation is necessary to reach sulfur levels of less than about 150 wppm, especially less than about 30 wppm. Further, at least 40, preferably at least 45, and more preferably at least 50 vol. % of the amount of olefins present in the feed is retained.

In one embodiment, the invention relates to a continuous process for hydrotreating a naphtha and then reducing the sulfur content of the hydrotreated naphtha product by the extraction of the acidic species such as mercaptans from the naphtha to an extractant portion of an aqueous treatment solution where the mercaptans subsist as mercaptides, and then separating a treated naphtha substantially reduced in mercaptans from the extractant portion while curtailing treatment solution entrainment in the treated naphtha. When the extraction is continuous, the extraction of the mercaptans from the hydrotreated naphtha to the extractant portion is preferably conducted under anaerobic conditions, i.e., in the substantial absence of added oxygen. In a subsequent stage, at least a portion of the treatment solution is conducted to an oxidizing stage where the mercaptides are converted to disulfides, which are water-insoluble. Following separation of the disulfides, the extractant portion is returned to the treatment composition for re-use. The extractant portion following disulfide separation is referred to as a regenerated extractant. In other embodiments, one or more of the following may also be incorporated into the process:

(i) stripping away the mercaptides from the treatment solution by e.g., steam stripping, (ii) polishing the treatment solution prior to re-use.

A catalytically effective amount of sulfonated cobalt phthalocyanine may be employed as a catalyst when the catalytic oxidation of the mercaptides is included in the process.

Figure 2:
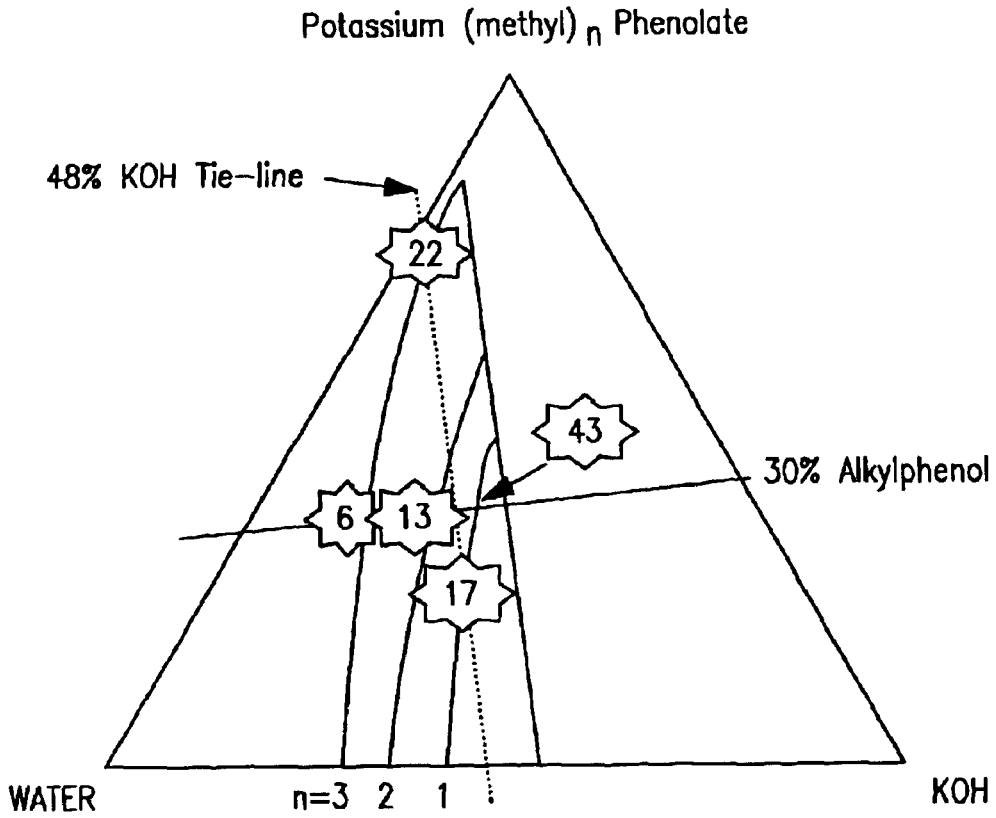
FIG. 2 shows a schematic phase diagram for a water-KOH-potassium alkyl phenylate treatment solution.

The treatment solution may be prepared by combining alkali metal hydroxide, alkylphenols, sulfonated cobalt pthalocyanine, and water. The amounts of the constituents may be regulated so that the treatment solution forms two substantially immiscible phases, i.e., a less dense, homogeneous, top phase of dissolved alkali metal hydroxide, alkali metal alkylphenylate, and water, and a more dense, homogeneous, bottom phase of dissolved alkali metal hydroxide and water. An amount of solid alkali metal hydroxide may be present, preferably a small amount (e.g., 10 wt. % in excess of the solubility limit), as a buffer, for example. When the treatment solution contains both top and bottom phases, the top phase is frequently referred to as the extractant or extractant phase. The top and bottom phases are liquid, and are substantially immiscible in equilibrium in a temperature ranging from about 80° F. to about 150° F. and a pressure range of about ambient (zero psig) to about 200 psig. Representative phase diagrams for a treatment solution formed from potassium hydroxide, water, and three different alkylphenols are shown in FIG. 2.

In one embodiment, therefore, a two-phase treatment solution is combined with the hydrocarbon to be treated and allowed to settle. Following settling, less dense treated hydrocarbon located above the top phase, and may be separated. In another embodiment, the top and bottom phases are separated before the top phase (extractant) contacts the hydrocarbon. As discussed, all or a portion of the top phase may be regenerated following contact with the hydrocarbon and returned to the process for re-use. For example, the regenerated top phase may be returned to the treatment solution prior to top phase separation, where it may be added to either the top phase, bottom phase, or both. Alternatively, the regenerated top phase may be added to the either top phase, bottom phase, or both subsequent to the separation of the top and bottom phases.

The treatment solution may also be prepared to produce a single liquid phase of dissolved alkali metal hydroxide, alkali metal alkylphenylate, sulfonated cobalt pthalocyanine, and water provided the single phase formed is compositionally located on the phase boundary between the one-phase and two-phase regions of the ternary phase diagram. In other words, the top phase may be prepared directly without a bottom phase, provided the top phase composition is regulated to remain at the boundary between the one phase and two phase regions of the dissolved alkali metal hydroxide-alkali metal alkylphenylate-water ternary phase diagram. The compositional location of the treatment solution may be ascertained by determining its miscibility with the analogous aqueous alkali metal hydroxide. The analogous aqueous alkali metal hydroxide is the bottom phase that would be present if the treatment solution had been prepared with compositions within the two-phase region of the phase diagram. As the top phase and bottom phase are homogeneous and immiscible, a treatment solution prepared without a bottom phase will be immiscible in the analogous aqueous alkali metal hydroxide.

Once an alkali metal hydroxide and alkylphenol (or mixture of alkyl phenols) are selected, a phase diagram defining the composition at which the mixture subsists in a single phase or as two or more phases may be determined. The phase diagram may be represented as a ternary phase diagram as shown in FIG. 2. A composition in the two phase region is in the form of a less dense top phase on the boundary of the one phase and two phase regions an a more dense bottom phase on the water-alkali metal hydroxide axis. A particular top phase is connected to its analogous bottom phase by a unique tie line. The relative amounts of alkali metal hydroxide, alkyl phenol, and water needed to form the desired single phase treatment solution at the phase boundary may then be determined directly from the phase diagram. If it is found that a single phase treatment solution has been prepared, but is not compositionally located at the phase boundary as desired, a combination of water removal or alkali metal hydroxide addition may be employed to bring the treatment solution's composition to the phase boundary. Since properly prepared treatment solutions of this embodiment will be substantially immiscible with its analogous aqueous alkali metal hydroxide, the desired composition may be prepared and then tested for miscibility with its analogous aqueous alkali metal hydroxide, and compositionally adjusted, if required.

Accordingly, in another embodiment, a single-phase treatment solution is prepared compositionally located at the boundary between one and two liquid phases on the ternary phase diagram, and then contacted with the hydrocarbon. After the treatment solution has been used to contact the hydrocarbon, it may be regenerated for re-use, as discussed for two-phase treatment solutions, but no bottom phase is present in this embodiment. Such a single-phase treatment solution is also referred to as an extractant, even when no bottom phase is present. Accordingly, when the treatment solution is located compositionally in the two-phase region of the phase diagram, the top phase is referred to as the extractant. When the treatment solution is prepared without a bottom phase, the treatment solution is referred to as the extractant.

While it is generally desirable to separate and remove sulfur from the hydrocarbon so as to form an upgraded hydrocarbon with a lower total sulfur content, it is not necessary to do so. For example, it may be sufficient to convert sulfur present in the feed into a different molecular form. In one such process, referred to as sweetening, undesirable mercaptans which are odorous are converted in the presence of oxygen to substantially less odorous disulfide species. The hydrocarbon-soluble disulfides then equilibrate (reverse extract) into the treated hydrocarbon. While the sweetened hydrocarbon product and the feed contain similar amounts of sulfur, the sweetened product contains less sulfur in the form of undesirable mercaptan species. The sweetened hydrocarbon may be further processed to reduce the total sulfur amount, by hydrotreating, for example.

The total sulfur amount in the hydrocarbon product may be reduced by removing sulfur species such as disulfides from the extractant. Therefore, in one embodiment, the invention relates to processes for treating a liquid hydrocarbon by the extraction of the mercaptans from the hydrocarbon to an aqueous treatment solution where the mercaptans subsist as water-soluble mercaptides and then converting the water-soluble mercaptides to water-insoluble disulfides. The sulfur, now in the form of hydrocarbon-soluble disulfides, may then be separated from the treatment solution and conducted away from the process so that a treated hydrocarbon substantially free of mercaptans and of reduced sulfur content may be separated from the process. In yet another embodiment, a second hydrocarbon may be employed to facilitate separation of the disulfides and conduct them away from the process. The process may be operated so that the flow of the treatment solution is cocurrent to naphtha flow, countercurrent to naphtha flow, or combination thereof.

Naphtha feeds or feedstocks useful as feeds to the hydrotreating stage include petroleum naphthas, steam cracked naphthas, coker naphthas, FCC naphthas and blends and fractions thereof, with end boiling points typically below about 450° F. Such naphthas typically contain 60 vol. % or less olefinic hydrocarbons, with sulfur levels as high as 3000 wppm and even higher (e.g., 7000 wppm). The naphtha feed to the hydrotreating stage, preferably a cracked naphtha, generally contains not only paraffins, naphthenes and aromatics, but also unsaturates, such as open-chain and cyclic olefins, dienes and cyclic hydrocarbons with olefinic side chains. A cracked naphtha feed generally has an overall olefin concentration ranging as high as about 60 vol. %, based on the volume of the feed. The olefin content of a typical cracked naphtha feed can broadly range from about 5 to about 60 vol. %, but more typically from about 10 to about 40 vol. %. It is preferred that the olefin concentration in the fresh naphtha feed be at least about 15 vol. % and preferably range between about 25 to about 60 vol. %, or higher. The diene concentration can be as much as 15 wt. %, but more typically ranges from about 0.2 wt. % to about 5 wt. % of the feed. High diene concentrations can result in a gasoline product with poor stability and color. The sulfur content of a naphtha feed to the hydrotreating stage can range from as low as 0.05 wt. %, up to as much as about 0.7 wt. %, based on the total feed composition. When the hydrotreating stage is a selective hydrotreating stage, the catalytically cracked naphtha and other high sulfur content naphthas useful as feeds have a sulfur content ranging from 0.1 to about 0.7 wt. %, more typically from about 0.15 wt % to about 0.7 wt. %, with about 0.2 to about 0.7 wt. % and even about 0.3 to about 0.7 wt. % being preferred. The nitrogen content will generally range from about 5 wppm to about 500 wppm, and more typically from about 20 wppm to about 200 wppm. Such naphtha streams can typically contain one or more mercaptan compounds, such as methyl mercaptan, ethyl mercaptan, n-propyl mercaptan, isopropyl mercaptan, n-butyl mercaptan, thiophenol and higher molecular weight mercaptans. The mercaptan compound is frequently represented by the symbol RSH, where R is normal or branched alkyl, or aryl.

In one embodiment, the naphtha desulfurization method is a two-step process having a first selective hydrotreating step followed by a mercaptan extraction step. The selective hydrotreating step may be a single stage or multiple stages arranged in series, parallel, or a combination thereof. Hydrogen flow may be co-current or counter-current with naphtha flow. Inter-stage, separation of treat gas and heteroatom gasses such as $H_2S$ may be employed between stages. Conventional selective hydrotreating conditions may be employed.

Accordingly, conventional selective hydrotreating, e.g., selective hydrodesulfurization, step hydrodesulfurization process may begin with a cracked naphtha feedstock preheating step. The feedstock may be preheated in feed/effluent heat exchangers prior to entering a furnace for final preheating to a targeted reaction zone inlet temperature. The feedstock can be contacted with a hydrogen-containing stream prior to, during, and/or after preheating. The hydrogen-containing stream can also be added in the hydrodesulfurization reaction zone or zones. The hydrogen stream can be pure hydrogen or can be in admixture with other components found in refinery hydrogen streams. It is preferred that the hydrogen-containing stream have little, if any, hydrogen sulfide. The hydrogen stream purity should be at least about 50% by volume hydrogen, preferably at least about 65% by volume hydrogen, and more preferably at least about 75% by volume hydrogen The reaction zone can consist of one or more fixed bed reactors each of which can comprise a plurality of catalyst beds. Since some olefin saturation will take place, and olefin saturation and the desulfurization reaction are generally exothermic, consequently inter-stage cooling between fixed bed reactors, or between catalyst beds in the same reactor shell, can be employed. A portion of the heat generated from the hydrodesulfurization process can be recovered and where this heat recovery option is not available, cooling may be performed through, e.g., cooling water or air, or through use of a hydrogen quench stream. In this manner, optimum reaction temperatures can be more easily maintained.

Selective hydrodesulfurization is preferably conducted with reactor inlet temperatures below the dew point of the feedstock so that the naphtha will not be completely vaporized at the reactor inlet. As the hydrodesulfurization reaction begins when the naphtha feed contacts the hydrodesulfurization catalyst, some of the exothermic heat of reaction is absorbed by the endothermic heat of vaporization, thus achieving 100% vaporization within the bed (dry point operation). By transferring some of the heat of reaction to vaporization, the overall temperature rise across the reactor is moderated, thus reducing the overall extent of olefin hydrogenation with only small reductions in hydrodesulfurization. The degree of vaporization should be greater than or equal to 0.990, but less than the ratio at which dry point operation is not achieved within the catalyst bed. That is, the ratio extends up to the point at which the operation stays all mixed phase in the reactor. The ratio limit may vary somewhat depending on selected operating conditions. The 0.990 ratio is specified to account for uncertainties in the measurement of the inlet temperature including variance in the location of the temperature measurement and uncertainties in the calculation of the actual dew point; however, the naphtha feedstock should not be completely vaporized at the reactor inlet.

Selective hydrotreating ranges for the temperature, pressure and treat gas ratio employed are as set forth in the Table below.

| Conditions | Selective Hydrotreating | Preferred | More Preferred |
|---|---|---|---|
| Temp., .degree. F. | 400–750 | 450–750 | 525–650 |
| Total Press., psig. | 60–2000 | 60–600 | 100–400 |
| Treat gas ratio, scf/b | 200–10000 | 1000–4000 | 2000–4000 |

The selective hydrotreating step generally operates at a liquid hourly space velocity of from about 0.5 $hr^{-1}$ to about 15 $hr^{-1}$, preferably from about 0.5 $hr^{-1}$ to about 10 $hr^{-1}$, and most preferably from about 1 $hr^{-1}$ to about 5 $hr^{-1}$. Conventional selective hydrotreating catalysts may be employed, e.g., those catalysts disclosed in U.S. Pat. No. 6,228,254. Preferably, the effluent from the hydrotreating step contains naphtha that is more than 80 wt. % (more preferably 90 wt. % and still more preferably 95 wt. %) desulfurized compared to the hydrotreater feed but with more than 30% (more preferably 50% and still more preferably 60%) of the olefins retained based on the amount of olefin in the hydrotreater feed.

As discussed, the effluent from the first step, i.e., the hydrotreating step, is then conducted to the extraction step where the amount of reversion mercaptans (and any mercaptans remaining from the hydrotreater feed) is diminished. Reversion mercaptans generally have a molecular weight ranging from about 90 to about 160 g/mole, and generally exceed the molecular weight of the mercaptans formed during heavy oil, gas oil, and resid cracking or coking, as these typically range in molecular weight from 48 to about 76 g/mole. The higher molecular weight of the reversion mercaptans and the branched nature of their hydrocarbon component make them more difficult to remove from the hydrotreated naphtha using conventional caustic extraction. The instant process, however, relates in part to the removal of high molecular weight and branched mercaptans, in addition to the lower molecular weight mercaptans found in the hydrotreater feed.

In one embodiment, the hydrotreated naphtha to be treated is contacted with a first phase of an aqueous treatment solution having two phases. The first phase contains dissolved alkali metal hydroxide, water, alkali metal alkylphenylate, and sulfonated cobalt phthalocyanine, and the second phase contains water and dissolved alkali metal hydroxide. Preferably, the alkali metal hydroxide is potassium hydroxide. The contacting between the treatment solution's first phase and the naphtha may be liquid-liquid. Alternatively, a vapor naphtha may contact a liquid treatment solution. Conventional contacting equipment such as packed tower, bubble tray, stirred vessel, fiber contacting, rotating disc contactor and other contacting apparatus may be employed. Fiber contacting is preferred. Fiber contacting, also called mass transfer contacting, where large surface areas provide for mass transfer in a non-dispersive manner is described in U.S. Pat. Nos. 3,997,829; 3,992,156; and 4,753,722. While contacting temperature and pressure may range from about 80° F. to about 150° F. and 0 psig to about 200 psig, preferably the contacting occurs at a temperature in the range of about 100° F. to about 140° F. and a pressure in the range of about 0 psig to about 200 psig, more preferably about 50 psig. Higher pressures during contacting may be desirable to elevate the boiling point of the hydrotreated naphtha so that the contacting may conducted with the naphtha in the liquid phase.

The treatment solution employed contains at least two aqueous phases, and is formed by combining alkylphenols, alkali metal hydroxide, sulfonated cobalt phthalocyanine, and water. Preferred alkylphenols include cresols, xylenols, methylethyl phenols, trimethyl phenols, naphthols, alkylnaphthols, thiophenols, alkylthiophenols, and similar phenolics. Cresols are particularly preferred. When alkylphenols are present in the naphtha to be treated, all or a portion of the alkylphenols in the treatment solution may be obtained from the naphtha feed. Sodium and potassium hydroxide are preferred metal hydroxides, with potassium hydroxide being particularly preferred. Di-, tri- and tetra-sulfonated cobalt pthalocyanines are preferred cobalt pthalocyanines, with cobalt phthalocyanine disulfonate being particularly preferred. The treatment solution components are present in the following amounts, based on the weight of the treatment solution: water, in an amount ranging from about 10 to about 50 wt. %; alkylphenol, in an amount ranging from about 15 to about 55 wt. %; sulfonated cobalt phthalocyanine, in an amount ranging from about 10 to about 500 wppm; and alkali metal hydroxide, in an amount ranging from about 25 to about 60 wt. %. The extractant should be present in an amount ranging from about 3 vol. % to about 100 vol. %, based on the volume of hydrodesulfurized naphtha to be treated.

As discussed, the treatment solution's components may be combined to form a solution having a phase diagram such as shown in FIG. 2, which shows the two-phase region for three different alkyl phenols, potassium hydroxide, and water. The preferred treatment solution has component concentrations such that the treatment solution will either (i) be compositionally in the two-phase region of the water-alkali metal hydroxide-alkali metal alkylphenylate phase diagram and will therefore form a top phase compositionally located at the phase boundary between the one and two-phase regions and a bottom phase, or (ii) be compositionally located at the phase boundary between the one and two-phase regions, with no bottom phase.

Following selection of the alkali metal hydroxide and the alkylphenol or alkylphenol mixture, the treatment solution's ternary phase diagram may be determined by conventional methods thereby fixing the relative amounts of water, alkali metal hydroxide, and alkyl phenol. The phase diagram can be empirically determined when the alkyl phenols are obtained from the hydrocarbon. Alternatively, the amounts and species of the alkylphenols in the hydrocarbon can be measured, and the phase diagram determined using conventional thermodynamics. The phase diagram is determined when the aqueous phase or phases are liquid and in a temperature in the range of about 80° F. to about 150° F. and a pressure in the range of about ambient (0 psig) to about 200 psig. While not shown as an axis on the phase diagram, the treatment solution contains dissolved sulfonated cobalt phthalocyanine. By dissolved sulfonated cobalt pthalocyanine, it is meant dissolved, dispersed, or suspended, as is known.

Whether the treatment solution is prepared in the two-phase region of the phase diagram or prepared at the phase boundary, the extractant will have a dissolved alkali metal alkylphenylate concentration ranging from about 10 wt. % to about 95 wt. %, a dissolved alkali metal hydroxide concentration in the range of about 1 wt. % to about 40 wt. %, and about 10 wppm to about 500 wppm sulfonated cobalt pthalocyanine, based on the weight of the extractant, with the balance being water. When present, the second (or bottom) phase will have an alkali metal hydroxide concentration in the range of about 45 wt. % to about 60 wt. %, based on the weight of the bottom phase, with the balance being water.

When extraction of higher molecular weight mercaptans (about $C_4$ and above, preferably about $C_5$ and above, and particularly from about $C_5$ to about $C_8$) is desired, such as in reversion mercaptan extraction, it is preferable to form the treatment solution towards the right hand side of the two-phase region, i.e., the region of higher alkali metal hydroxide concentration in the bottom phase. It has been discovered that higher extraction efficiency for the higher molecular weight mercaptans can be obtained at these higher alkali metal hydroxide concentrations. The conventional difficulty of treatment solution entrainment in the treated naphtha, particularly at the higher viscosities encountered at higher alkali metal hydroxide concentration, is overcome by providing sulfonated cobalt phthalocyanine in the treatment solution. As is clear from FIG. 2, the mercaptan extraction efficiency is set by the concentration of alkali metal hydroxide present in the treatment solution's bottom phase, and is substantially independent of the amount and molecular weight of the alkylphenol, provided more than a minimum of about 5 wt. % alkylphenol is present, based on the weight of the treatment solution.

The extraction efficiency, as measured by the extraction coefficient, $K_{eq}$, shown in FIG. 2 is preferably higher than about 10, and is preferably in the range of about 20 to about 60. Still more preferably, the alkali metal hydroxide in the treatment solution is present in an amount within about 10% of the amount to provide saturated alkali metal hydroxide in the second phase. As used herein, $K_{eq}$ is the concentration of mercaptide in the extractant divided by the mercaptan concentration in the product, on a weight basis, in equilibrium, following mercaptan extraction from the feed naphtha to the extractant.

A simplified flow diagram for one embodiment is illustrated in FIG. 1. A naphtha feed via line 30 and a hydrogen-containing gas via line 31 are conducted to hydrotreater 32 where the naphtha is desulfurized, preferably under selective hydrotreating conditions. Hydrotreater effluent is conducted via line 33 to separator 34 where a hydrotreated naphtha is separated and conducted to the extraction step via line 2. Heteroatom vapors and hydrogen are also separated, and are conducted away from the process via line 35.

Extractant in line 1 and the selectively hydrotreated naphtha feed in line 2 are conducted to mixing region 3 where mercaptans are removed from the hydrocarbon to the extractant. Hydrocarbon and extractant are conducted through line 4 to settling region 5 where the treated naphtha, lower in mercaptan sulfur compared to the hydrotreated naphtha and lower in sulfur than the hydrotreater feed, is separated and conducted away from the process via line 6. The extractant, now containing mercaptides, is shown in the lower (hatched) portion of the settling region. A bottom phase (not shown) may be present. The extractant may then be conducted away from the process.

In a preferred embodiment, the extractant containing mercaptan sulfur in the form of mercaptides is regenerated and re-used. Accordingly, the extractant may be conducted via line 7 to oxidizing region 8 where the mercaptides in the extractant are oxidized to disulfides in the presence of an oxygen-containing gas, conducted to region 8 via line 12 and sulfonated cobalt pthalocyanine, which is effective as an oxidation catalyst. Undesirable oxidation by-products such as water and off-gasses may be conducted away from the process via line 9. Additional sulfonated cobalt pthalocyanine may be added via line 10 if needed. Optionally, a water-immiscible solvent such as a hydrocarbon may be introduced into the oxidizing region to aid in disulfide separation, as shown by line 14.

The disulfides may be separated and conducted away from the process. The regenerated extractant may then be returned to the process and introduced, for example, into the lower portion (hatched) of region 29. Alternatively, as shown in the figure, the solvent containing the disulfides is conducted to a polishing region 16 via line 11, together with the regenerated extractant. When polishing is employed, fresh solvent is introduced into the polishing region via line 15 where it contacts the effluent of line 11. Conventional contacting may be employed, and fiber contacting is preferred. Effluent from the polishing region is conducted to a second settling region 19 via line 17. Solvent containing disulfides may be conducted away from the process via line 18.

Polished extractant from the bottom (hatched) portion of region 19 may be conducted to the lower (hatched) portion of settling region 29. A concentrator 21, when employed, removes water from the bottom phase conducted from the lower portion of region 29 to assist in regulating the treatment solution's composition. The water may be removed by, e.g., steam stripping or some other conventional water removal process. Concentrated bottom phase is conducted from the concentrating region to third settling region 29 where it is added to the treatment solution, preferably to the bottom phase via line 23, as shown in the hatched area of 29. Preferably, the concentrated bottom phase in line 23 is combined with extractant in line 20 in a mixing region (not illustrated) where the extractant and bottom phase re-equilibrate prior to returning the two phases to region 29. A portion of the treatment solution (preferably bottom phase) may be separated from line 24 (24*a*), and fresh alkali metal hydroxide (line 26) and water (line 27), may be added to region 29 via line 25 to regulate the treatment solution's composition. Alkylphenols may be added vial line 28, if needed. Preferably, the composition is regulated to remain compositionally located in the two-phase region of the phase diagram. Accordingly, under the influence of gravity, the bottom phase will be located in the lower portion (hatched) of the third settling region. The top phase (the extractant), compositionally located on the phase boundary between the one and two-phase regions of the ternary phase diagram is withdrawn from the upper region and conducted to the start of the process via line 1. If desired, fresh extractant can also be introduced via line 1.

In one embodiment, the contacting and settling shown in regions 3 and 5 (and 16 and 19) occur in a common vessel with no interconnecting lines. In that embodiment, fiber contacting is preferred.

The present process is effective for reducing the sulfur content of a naphtha, particularly for naphtha used to for a gasoline stream or gasoline. As used herein, a gasoline stream includes individual refinery streams suitable for use as a blend stock for gasoline, or a blended gasoline stream containing two or more streams, each of which are suitable for use as a gasoline blend stock. A suitable gasoline blend stock, when blended with other refinery streams, produces a combined stream which meets the requirements for gasoline, which are documented in Federal and State regulations.

EXAMPLE 1

Impact of Sulfonated Cobalt Pthalocyanine on Droplet Size Distribution

A LASENTECH™ (Laser Sensor Technology, Inc., Redmond, Wash. USA), Focused Laser Beam Reflecatance Measuring Device (FBRM®) was used to monitor the size of dispersed aqueous potassium cresylate droplets in a continuous naphtha phase. The instrument measures the back-reflectance from a rapidly spinning laser beam to determine the distribution of "chord lengths" for particles that pass through the point of focus of the beam. In the case of spherical particles, the chord length is directly proportional to particle diameter. The data is collected as the number of counts per second sorted by chord length in one thousand linear size bins. Several hundred thousand chord lengths are typically measured per second to provide a statistically significant measure of chord length size distribution. This methodology is especially suited to detecting changes in this distribution as a function of changing process variables.

In this experiment, a representative treatment solution was prepared by combining 90 grams of KOH, 50 grams of water and 100 grams of 3-ethyl phenol at room temperature. After stirring for thirty minutes, the top and bottom phases were allowed to separate and the less dense top phase was utilized as the extractant. The top phase had a composition of about 36 wt. % KOH ions, about 44 wt. % potassium 3-ethyl phenol ions, and about 20 wt. % water, based on the total weight of the top phase, and the bottom phase contained approximately 53 wt. % KOH ions, with the balance water, based on the weight of the bottom phase.

First, 200 mls of light virgin naphtha was stirred at 400 rpm and the FBRM probe detected very low counts/sec to determine a background noise level. Then, 20 mls of the top phase from the KOH/alkyl phenol/water mixture described above was added. The dispersion that formed was allowed to stir for 10 minutes at room temperature. At this time the FBRM provided a stable histogram for the chord length distribution. Then, while still stirring at 400 rpm, a sulfonated cobalt pthalocyanine was added. The dispersion immediately responded to the addition, with the FBRM recording a significant and abrupt change in the chord length distribution. Over the course of another five minutes, the solution stabilized at a new chord length distribution. The most noticeable impact of the addition of sulfonated cobalt pthalocyanine was to shift the median chord length to larger values (length weighted): without sulfonated cobalt pthalocyanine, 14 microns; after addition of sulfonated cobalt pthalocyanine, 35 microns.

It is believed that the sulfonated cobalt pthalocyanine acts to reduce the surface tension of the dispersed extractant droplets, which results in their coalescence into larger median size droplets. In a preferred embodiment, where non-dispersive contacting is employed using, e.g., a fiber contactor, this reduced surface tension has two effects. First, the reduced surface tension enhances transfer of mercaptides from the naphtha phase into the extractant which is constrained as a film on the fiber during the contacting. Second, any incidental entrainment would be curtailed by the presence of the sulfonated cobalt pthalocyanine.

EXAMPLE 2

Determination of Extraction Coefficients for Selectively Hydrotreated Naphtha Determination of mercaptan extraction coefficient, $K_{eq}$, was conducted as follows. About 50 mls of selectively hydrotreated naphtha was poured into a 250 ml Schlenck flask to which had been added a Teflon-coated stir bar. This flask was attached to an inert gas/vacuum manifold by rubber tubing. The naphtha was degassed by repeated evacuation/nitrogen refill cycles (20 times). Oxygen was removed during these experiments to prevent reacting the extracted mercaptide anions with oxygen, which would produce naphtha-soluble disulfides. Due to the relatively high volatility of naphtha at room temperature, two ten mls sample of the degassed naphtha were removed by syringe at this point to obtain total sulfur in the feed following degassing. Typically the sulfur content was increased by 2–7-wppm sulfur due to evaporative losses. Following degassing, the naphtha was placed in a temperature-controlled oil bath and equilibrated at 120° F. with stirring. Following a determination of the ternary phase diagram for the desired components, the extractant for the run was prepared so that it was located compositionally in the two-phase region. Excess extractant was also prepared, degassed, the desired volume is measured and then transferred to the stirring naphtha by syringe using standard inert atmosphere handling techniques. The naphtha and extractant were stirred vigorously for five minutes at 120° F., then the stirring was stopped and the two phases were allowed to separate. After about five minutes, twenty mls of extracted naphtha were removed while still under nitrogen atmosphere and loaded into two sample vials. Typically, two samples of the original feed were also analyzed for a total sulfur determination, by x-ray fluorescence. The samples are all analyzed in duplicate, in order to ensure data integrity. The reasonable assumption was made that all sulfur removed from the feed resulted from mercaptan extraction into the aqueous extractant. This assumption was verified on several runs in which the mercaptan content was measured. As discussed, the Extraction Coefficient, $K_{eq}$, is defined as the ratio of sulfur concentration present in the form of mercaptans ("mercaptan sulfur") in the extractant divided by the concentration of sulfur in the form or mercaptides (also called "mercaptan sulfur") in the selectively hydrotreated naphtha following extraction:

$$K_{eq} = \frac{[RS^- M^+ \text{ in extractant}]}{[RSH \text{ in feed}]} \text{ after extraction.}$$

EXAMPLE 3

Extraction Coefficients Determined at Constant Cresol Weight %

As is illustrated in FIG. 2 the area of the two-phase region in the phase diagram increases with alkylphenol molecular weight. These phase diagrams were determined experimentally by standard, conventional methods. The phase boundary line shifts as a function of molecular weight and also determines the composition of the extractant phase within the two-phase region. In order to compare the extractive power of two-phase extractants prepared from different molecular weight alkylphenols, extractants were prepared having a constant alkylphenol content in the top layer of about 30 wt. %. Accordingly, starting composition were selected for each of three different molecular weight alkylphenols to achieve this concentration in the extractant phase. On this basis, 3-methylphenol, 2,4-dimethylphenol and 2,3,5-trimethylphenol were compared and the results are depicted in FIG. 2.

The figure shows the phase boundary for each of the alkylphenols with the 30% alkylphenol line is shown as a sloping line intersecting the phase boundary lines. The measured $K_{eq}$ for each extractant, on a wt./wt. basis are noted at the point of intersection between the 30% alkyl phenol line and the respective alkylphenol phase boundary. The measured $K_{eq}$s for 3-methylphenol, 2,4-dimethylphenol, and 2,3,5-trimethylphenol were 43, 13, and 6 respectively. As can be seen in this figure, the extraction coefficients for the two-phase extractant at constant alkylphenol content drop significantly as the molecular weight of the alkylphenol increases. Though the heavier alkylphenols produce relatively larger two-phase regions in the phase diagram, they exhibit reduced mercaptan extraction power for the extractants obtained at a constant alkylphenol content. A second basis for comparing the extractive power of two-phase extractant systems is also illustrated in FIG. 2. The dashed 48% KOH tie-line delineates compositions in the phase diagram which fall within the two-phase region and share the same second phase (or more dense phase, frequently referred to as a bottom phase) composition: 48 wt. % KOH. All starting compositions along this tie-line will phase separate into two phases, the bottom phase of which will be 48 wt. % KOH in water. Two extractant compositions were prepared such that they fell on this tie-line although they were prepared using different molecular weight alkylphenols: 3-methyl phenol and 2,3,5 trimethylphenol. The extraction coefficients were determined as described above and were found to be 17 and 22 respectively. Surprisingly, in contrast to the constant alkylphenol content experiments in which large differences in extractive power were observed, these two extractants showed nearly identical $K_{eq}$. This example demonstrates that the mercaptan extraction efficiency is determined by the concentration of alkali metal hydroxide present in the bottom phase, and is substantially independent of the amount and molecular weight of the alkyl phenol.

EXAMPLE 4

Measurement of Mercaptan Removal from Naphtha

A representative treatment solution was prepared by combining 458 grams of KOH, 246 grams of water and 198 grams of alkyl phenols at room temperature. After stirring for thirty minutes, the mixture was allowed to separate into two phases, which were separated. The extractant (less dense) phase had a composition of about 21 wt. % KOH ions, about 48 wt. % potassium methyl phenylate ions, and about 31 wt. % water, based on the total weight of the extractant, and the bottom (more dense) phase contained approximately 53 wt % KOH ions, with the balance water, based on the weight of the bottom phase.

One part by weight of the extractant phase was combined with three parts by weight of a selectively hydrotreated intermediate cat naphtha ("ICN") having an initial boiling point of about 90° F. The ICN contained $C_6$, $C_7$, and $C_8$ recombinant mercaptans. The ICN and extractant were equilibrated at ambient pressure and 135° F., and the concentration of $C_6$, $C_7$, and $C_8$ recombinant mercaptan sulfur in the naphtha and the concentration of $C_6$, $C_7$, and $C_8$ recombinant mercaptan sulfur in the extractant were determined. The resulting $K_{eq}$ s were calculated and are shown in column 1 of the table.

For comparison, a conventional (from the prior art) extraction of normal mercaptans from gasoline using a 15 wt. % sodium hydroxide solution at 90° F. is shown in column 2 of the table. The comparison demonstrates that the extraction power of the more difficult to extract recombinant mercaptans using the instant process is more than 100 times greater than the extractive power of the conventional process with the less readily extracted normal mercaptans.

| Mercaptan Molecular Weight | $K_{eq}$, Extractant from top phase | $K_{eq}$, Single phase extractant |
|---|---|---|
| $C_1$ | — | 1000 |
| $C_2$ | — | 160 |
| $C_3$ | — | 30 |
| $C_4$ | — | 5 |
| $C_5$ | — | 1 |
| $C_6$ | 15.1 | 0.15 |
| $C_7$ | 7.6 | 0.03 |
| $C_8$ | 1.18 | Not measurable |

As is clear from the table, greatly enhanced $K_{eq}$ is obtained when the extractant is the top phase of a two-phase treatment solution compared with a conventional extractant, i.e., an extractant obtained from a single-phase treatment solution not compositionally located on the boundary between the one phase and two-phase regions. The top phase extractant is particularly effective for removing high molecular weight mercaptans. For example, for $C_6$ mercaptans, the $K_{eq}$ of the top phase extractant is one hundred times larger than the $K_{eq}$ obtained using an extractant prepared from a single-phase treatment solution. The large increase in $K_{eq}$ is particularly surprising in view of the higher equilibrium temperature employed with the top phase extractant because conventional kinetic considerations would be expected to lead to a decreased $K_{eq}$ as the equilibrium temperature was increased from 90° F. to 135° F.

EXAMPLE 5

Mercaptan Extraction from Natural Gas Condensates

A representative two-phase treatment solution was prepared as in as in Example 4. The extractant phase had a composition of about 21 wt. % KOH ions, about 48 wt. % potassium dimethyl phenylate ions, and about 31 wt. % water, based on the total weight of the extractant, and the bottom phase contained approximately 52 wt. % KOH ions, with the balance water, based on the weight of the bottom phase.

One part by weight of the extractant was combined with three parts by weight of a natural gas condensate containing branched and straight-chain mercaptans having molecular weights of about $C_5$ and above. The natural gas condensate had an initial boiling point of 91° F. and a final boiling point of 659° F., and about 1030 ppm mercaptan sulfur. After equilibrating at ambient pressure and 130° F., the mercaptan sulfur concentration in the extractant was measured and compared to the mercaptan concentration in the condensate, yielding a $K_{eq}$ of 11.27.

For comparison, the same natural gas condensate was combined on a 3:1 weight basis with a conventional extractant prepared from a conventional single phase treatment composition that contained 15% dissolved sodium hydroxide, i.e., a treatment composition compositionally located well away from the boundary with the two-phase region on the ternary phase diagram. Following equilibration under the same conditions, the mercaptan sulfur concentration was determined, yielding a much smaller $K_{eq}$ of 0.13. This example demonstrates that the extractant prepared from a two-phase treatment solution is nearly two orders of magnitude more effective in removing from a hydrocarbon branched and straight-chain mercaptans having a molecular weight greater than about $C_5$.

EXAMPLE 6

Reversion Mercaptan Extractive Power of Single Versus Two-Phase Extraction Compositions of Nearly Identical Composition Three treatment compositions were prepared (runs numbered 2, 4, and 6) compositionally located within the two-phase region. Following its separation from the treatment composition, the top phase (extractant) was contacted with naphtha as set forth in example 2, and the $K_{eq}$ for each extractant was determined. The naphtha contained reversion mercaptans, including reversion mercaptans having molecular weights of about $C_5$ and above. The results are set forth in the table.

By way of comparison, three conventional treatment compositions were prepared (runs numbered 1, 3, and 5) compositionally located in the single-phase region of the ternary phase diagram, but near the boundary of the two-phase region. The treatment compositions were contacted with the same naphtha, also under the conditions set forth in example 2, and the $K_{eq}$ was determined. These results are also set forth in the table.

For reversion mercaptan removal, the table clearly shows the benefit of employing extractant compositionally located on the phase boundary between the one-phase and two-phase regions of the phase diagram. Extractants compositionally located near the phase boundary, but within the one-phase region, show a $K_{eq}$ about a factor of two lower than the $K_{eq}$ of similar extractants compositionally located at the phase boundary.

| Run # | # of phases in treatment compostition | K-cresylate (wt. %) | KOH (wt. %) | Water (wt. %) | Keq (wt./wt.) |
|---|---|---|---|---|---|
| 1 | 1 | 15 | 34 | 51 | 6 |
| 2 | 2 | 15 | 35 | 50 | 13 |
| 3 | 1 | 31 | 27 | 42 | 15 |
| 4 | 2 | 31 | 28 | 41 | 26 |
| 5 | 1 | 43 | 21 | 34 | 18 |
| 6 | 2 | 43 | 22 | 35 | 36 |

What is claimed is:

1. A naphtha desulfurization method, comprising:

(a) contacting a sulfur-containing naphtha with hydrogen in the presence of a catalytically effective amount of a hydrotreating catalyst under catalytic hydrotreating conditions to form a hydrodesulfurized naphtha;

(b) contacting the hydrodesulfurized naphtha with a first phase of a treatment composition containing water, alkali metal hydroxide, cobalt phthalocyanine sulfonate, and alkylphenols and having at least two phases, (i) the first phase containing dissolved alkali metal alkylphenylate, dissolved alkali metal hydroxide, water, and dissolved sulfonated cobalt phthalocyanine, and (ii) the second phase containing water and dissolved alkali metal hydroxide;

(c) extracting mercaptan sulfur from the hydrodesulfurized naphtha to the first phase; and (d) separating an upgraded naphtha having less mercaptan sulfur than the hydrodesulfurized naphtha.

2. The method of claim 1 wherein, during the contacting of step (b), the first phase is applied to and flows over and along hydrophylic metal fibers, and the hydrocarbon flows over the first phase co-current with first phase flow.

3. The method of claim 2 wherein the mercaptans are reversion mercaptans.

4. The method of claim 3 wherein the reversion mercaptans have a molecular weight greater than about $C_4$.

5. The method of claim 4 wherein the reversion mercaptans have a molecular weight ranging from about $C_5$ to about $C_8$.

6. The method of claim 1 wherein the sulfonated cobalt phthalocyanine is present in the first phase in an amount ranging from about 10 to about 500 wppm, based upon the weight of the treatment solution.

7. The method of claim 1 wherein the treatment composition contains about 15 wt. % to about 55 wt. % dissolved alkylphenols, about 10 wppm to about 500 wppm dissolved sulfonated cobalt phthalocyanine, about 25 wt. % to about 60 wt. % dissolved alkali metal hydroxide, and about 10 wt. % to about 50 wt. % water, based on the weight of the treatment solution.

8. The method of claim 7 wherein the first phase is present in step (b) in an amount ranging from about 3 vol. % to about 100 vol. %, based on the volume of the hydrodesulfurized naphtha, and the contacting is conducted in the substantial absence of oxygen.

9. The method of claim 1 wherein at least a portion of the alkylphenols are cresols obtained from the hydrodesulfurized naphtha.

10. The method of claim 1 wherein the sulfonated cobalt phthalocyanine is cobalt phthalocyanine disulfonate.

11. The method of claim 1 further comprising conducting an oxidizing amount oxygen and the first phase from step (c) to an oxidizing region and oxidizing the mercaptan sulfur in the first phase to disulfides, separating the disulfides from the first phase, and then conducting the first phase to a polishing region wherein a water-immiscible solvent further separates disulfides from the first phase, wherein the contacting of step (b) is conducted under substantially anaerobic conditions.

12. The method of claim 11 further comprising conducting the second phase from step (b) to a concentrating region wherein water is removed from the second phase to regulate the treatment composition's water content; and conducting the concentrated second phase from the concentrating region to the second phase of step (b) for re-use.

13. The method of claim 12 wherein the treatment composition is formed by combining water in an amount ranging from about 10 wt. % to about 50 wt. %, alkali metal hydroxide in an amount ranging from about 25 wt. % to about 60 wt. %, sulfonated cobalt phthalocyanine in an amount ranging from about 10 wppm to about 500 wppm, and alkylphenols in an amount ranging from about 10 wt. % to about 50 wt. %, based on the weight of the treatment composition.

14. The method of claim 13 wherein (i) the hydrocarbon is a selectively hydrotreated naphtha containing reversion mercaptans, (ii) at least a portion of the alkylphenols are cresols obtained from the selectively hydrotreated naphtha, (iii) wherein the reversion mercaptans have a molecular weight greater than about $C_5$, (iv) the sulfonated cobalt pthalocyanine is cobalt pthalocyanine disulfonate, and (v) wherein the method is operated continuously.

15. A continuous method for treating and upgrading a selectively hydrotreated naphtha, comprising:

(a) contacting a selectively hydrotreated naphtha under substantially anaerobic conditions with an extractant composition, wherein (i) the extractant is substantially immiscible with its analogous bottom phase of aqueous alkali metal hydroxide, and (ii) the extractant contains water, dissolved alkali metal alkylphenylate, dissolved alkali metal hydroxide, and dissolved sulfonated cobalt phthalocyanine;

(b) extracting mercaptan sulfur from the naphtha to the extractant;

(c) separating (i) an extractant containing mercaptan sulfur and (ii) an upgraded naphtha having less mercaptan sulfur than the selectively hydrotreated naphtha.

16. The method of claim 15 wherein the naphtha contains reversion mercaptans having a molecular weight greater than about $C_4$.

17. The method of claim 16 wherein the reversion mercaptans have a molecular weight greater ranging from about $C_5$ to about $C_8$.

18. The method of claim 15 wherein, during the contacting of step (a), the extractant is applied to and flows over and along hydrophylic metal fibers, and the selectively hydrotreated naphtha flows over the extractant co-current with the flow of extractant.

19. The method of claim 15 wherein the extractant composition is formed by combining water in an amount ranging from about 10 wt. % to about 50 wt. %, alkali metal hydroxide in an amount ranging from about 25 wt. % to about 60 wt. %, sulfonated cobalt phthalocyanine in an amount ranging from about 10 ppm to about 500 ppm, and alkylphenols in an amount ranging from about 10 wt. % to about 50 wt. %, based on the weight of the extractant, and wherein at least a portion of the alkyl phenols are cresols obtained from the selectively hydrotreated naphtha.

20. The method of claim 19 wherein the extractant is present in an amount ranging from about 3 vol. % to about 100 vol. %, based on the volume of the hydrocarbon, and wherein the extractant contains dissolved alkali metal hydroxide in an amount ranging from about 1 wt. % to about 40 wt. %, dissolved alkali metal alkylphenylate ions in an amount ranging from about 10 wt. % to about 95 wt. %, and sulfonated cobalt pthalocyanine in an amount ranging from about 10 ppm to about 500 ppm, based on the weight of the extractant.

21. The method of claim 20 wherein the sulfonated cobalt phthalocyanine is cobalt phthalocyanine disulfonate.

22. The method of claim 15 further comprising (d) conducting an oxidizing amount oxygen and the extractant containing mercaptan sulfur to an oxidizing region and oxidizing the mercaptan sulfur to disulfides;

(e) separating the disulfides from the extractant;

(f) conducting at least a portion of the extractant in step (e) to a polishing region, wherein a water-immiscible solvent further separates disulfides from the extractant prior to the re-use of the extractant.

23. The method of claim 22 further comprising (g) conducting the bottom phase from step (a) to a concentrating region wherein water is removed from the bottom phase to regulate the extractant's water content; and then (h) conducting the bottom phase away from the concentrating region to step (a) for re-use.

24. The method of claim 23 wherein (i) the hydrocarbon is a selectively hydrotreated naphtha containing reversion mercaptans and cresols, (ii) the extractant contains alkylphenols obtained from the cresols in the selectively hydrotreated naphtha, (iii) wherein the reversion mercaptans have a molecular weight greater than about $C_5$, and (iv) the sulfonated cobalt pthalocyanine is cobalt pthalocyanine disulfonate.

* * * * *